United States Patent [19]

Pekko et al.

[11] 3,973,788

[45] Aug. 10, 1976

[54] UNDERSURFACE IMPRINTABLE LABEL CONSTRUCTION

[75] Inventors: John A. Pekko, Whittier; Robert J. Cardenas, Azusa, both of Calif.

[73] Assignee: Avery International, San Marino, Calif.

[22] Filed: Sept. 26, 1973

[21] Appl. No.: 400,828

[52] U.S. Cl. ..... 282/19 R; 40/2.2; 282/1 R; 282/21 R; 282/28 R

[51] Int. Cl.[2] ..... B41L 5/00

[58] Field of Search ..... 282/1 R, 11.5 R, 11.5 A, 282/12 R, 12 A, 19 R, 20 R, 21 R, 28 R; 281/15; 40/2 R, 2.2

[56] References Cited

UNITED STATES PATENTS

| | | | |
|---|---|---|---|
| 2,520,077 | 8/1950 | Wolowitz | 282/28 R X |
| 2,648,924 | 8/1953 | Brewster | 282/28 R X |
| 2,666,655 | 1/1954 | Wolowitz | 282/25 |
| 2,670,971 | 3/1954 | Johnson | 282/19 R |
| 3,104,799 | 9/1963 | Steidinger | 282/11.5 A X |
| 3,383,121 | 5/1968 | Singer | 282/28 R |
| 3,631,617 | 1/1972 | Pekko | 40/2.2 |

FOREIGN PATENTS OR APPLICATIONS

| | | | |
|---|---|---|---|
| 514,211 | 6/1955 | Canada | 282/28 R |
| 687,354 | 2/1953 | United Kingdom | 282/22 R |
| 1,167,585 | 10/1969 | United Kingdom | 281/5 |

*Primary Examiner*—Jerome Schnall
*Attorney, Agent, or Firm*—Christie, Parker & Hale

[57] ABSTRACT

An undersurface imprintable label construction includes at least a translucent film having a layer of adhesive applied to a portion of its undersurface. One or more non-adhesive indicia-receiving zone(s) are on the undersurface of the film to form translucent window(s) on the film. A pressure-sensitive adhesive layer surrounds the window(s) and is releasably secured to a release liner which contains an indicia-transferring layer, such as a reverse carbon paper sheet, facing the undersurface of the film window(s). The undersurface of the film window area being disposed adjacent the indicia-transferring layer in the release liner allows visual indicia to be transferred from the indicia-transferring layer and imprinted on the undersurface of the window area(s) in response to pressure impact being applied to the upper surface of the film window area(s). The undersurface of the film may be partially masked to make the label substantially tamperproof.

11 Claims, 7 Drawing Figures

UNDERSURFACE IMPRINTABLE LABEL CONSTRUCTION

BACKGROUND OF THE INVENTION

This invention relates to labels, and more particularly to a label which can receive and protect information from an impact imprinting source, such as a computer printer.

Recently, the United States Federal Highway Administration developed a regulation requiring all manufacturers of motor vehicles to provide certification labels on all vehicles certifying that the vehicle meets certain federal safety standards. The required certification label must remain in place and be legible for the life of the vehicle.

Because of the large quantity of safety certification labels required by the auto manufacturers, and the resulting necessity that the labels be produced economically, the information required by the federal standards has been computer-printed on safety certification labels. However, printing, whether it be by computer printing or by typewriter, is not a durable form of intelligence, because the ink from the printing can be smeared, erased, or otherwise defaced during use of the label.

In one prior art safety certification label, the required information is printed by computer on a face label which is then overlaminated with a label overlay to protect the computer-printed information which otherwise might be defaced if the overlay is removed. The disadvantages of such a label are the relatively high cost and excessive amount of time and materials required in the two-step process of computer-printing and combined label application.

SUMMARY OF THE INVENTION

The present invention provides a label which can be computer-underprinted with protected intelligent information in one step. When the label is in use, the protected underprinted information cannot be altered by pressure being applied to the surface of the label.

Briefly, the label provided by this invention is an undersurface imprintable label construction which includes a self-supporting film at least a portion of which is translucent, i.e., light transmitting, and a pressure-sensitive adhesive layer covering only a portion of the bottom surface of the self-supporting film. The adhesive layer is so distributed on the film that a non-adhesive zone may be formed on the bottom surface of the film coincident with the translucent portion of the film to provide an indicia-receiving window area(s) on the film. A release liner below the adhesive layer of the film acts as a carrier for the self-supporting film. The release liner has a release layer adjacent the pressure-sensitive adhesive layer of the film for allowing the film to be readily released from the release liner.

An indicia-transferring layer on the release liner faces the non-adhesive zone(s) of the film bottom surface. The indicia-transferring layer is capable of transferring visual indicia to a surface in contact with it in response to pressure being applied to the indicia-transferring layer.

An indicia-receptive layer on the non-adhesive zone of the film bottom surface is disposed adjacent the indicia-transferring layer. The indicia-receptive layer allows visual indicia to be transferred from the indicia-transferring layer and imprinted on the bottom surface of the film window area(s) in response to pressure being applied to the upper surface of the film indicia-receiving area.

Thus, images produced by computer imprinting on the label are transferred to the underside of the translucent film. The film can then be removed from the release liner and mounted on an automobile or other substrate. The film protects the underimprinted intelligence from the application of surface pressures or the like which would otherwise deface information which is transfer-printed on an exposed face of the label. The imprinted information also is of permanent nature, because information and/or markings cannot be added to the label, in the absence of removing the label. Moreover, the imprinting of the label can be produced in one economical step in a computer printer without requiring the subsequent addition of a protective overlay or the like.

In addition to the above advantages, the label provided by this invention can be made tamperproof by the addition of a differential-adhesive, partially masked surface layer below the film, so that attempts to remove the label for the purpose of transferring it will result in a detectable and irreversible breakup of permanent and repetitive indicia.

These and other aspects of the invention will be more fully understood by referring to the following detailed description and the accompanying drawings.

DETAILED DESCRIPTION OF THE PREFERRED EMBODIMENTS

Figure 1:
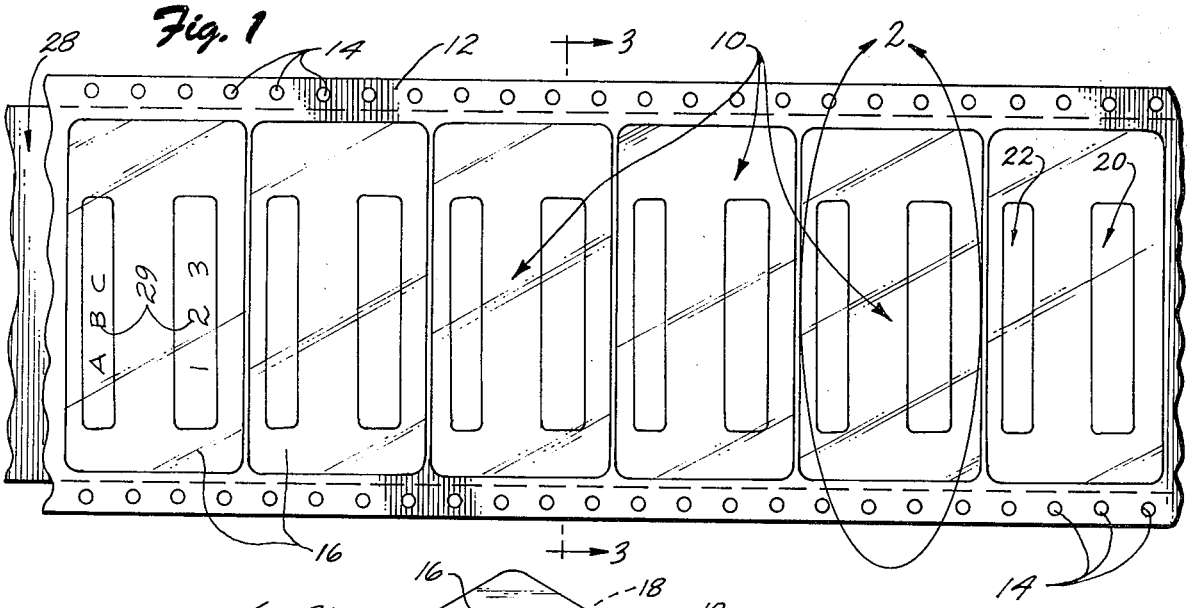
FIG. 1 is a fragmentary plan view showing the undersurface imprintable label construction of this invention embodied in a series of labels secured to a strip of paper for feed through a computer for imprinting information on the labels.

FIG. 1 shows a series of longitudinally spaced apart pressure-sensitive adhesive labels 10 provided according to this invention secured to a release coated paper strip 12 having marginal pin feed holes 14 along its edges for use in feeding the strip through a computer (not shown) for printing information on the labels.

Figure 2:
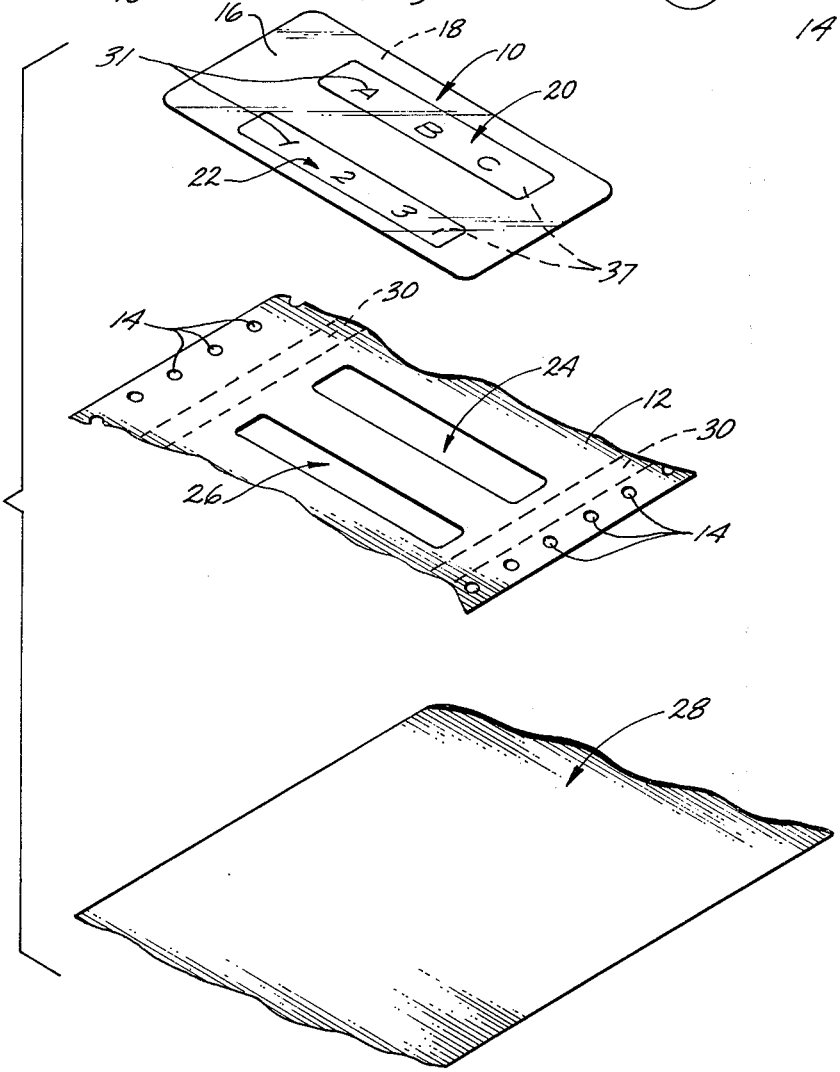
FIG. 2 is an exploded fragmentary perspective view of the label construction shown within the circle 2 of FIG. 1.

FIG. 2 illustrates the basic components of the label construction of this invention which includes a self-supporting film 16 having a pressure-sensitive adhesive layer 18 on its undersurface, the layer being natural tinted and/or separated by a colored adhesive ink layer. Either construction may include imprinted indicia. The adhesive layer may contain pigments or the like which when applied to a translucent or transparent film 16 form a substantially opaque areas on the film. In this instance, the adhesive is so distributed that at least one or more non-adhesive zones are formed such as to provide translucent window areas 20 and 22 in the film. The term "translucent" is used herein to mean that indicia imprinted on the undersurface of window areas 20 and 22 will be visible through the window areas of film 16 and thus the term is intended to encompass film window areas which are transparent as well as those known to be translucent.

The pressure-sensitive adhesive-backed film 16 provides the pressure sensitive label 10 which is capable of being releasably secured to the release surface of paper strip 12. Labels 10 are applied to strip 12 so that windows 20 and 22 of each label are substantially positioned directly over corresponding openings 24 and 26, respectively, in release coated strip 12. An elongated strip 28 or corresponding segments of an image-transferring layer, such as carbon paper which can be continuous with the length of paper strip 12, is secured to the underside of strip 12 by adhesive layers 30 on the undersurface of strip 12. The carbon layer of the carbon paper strip or image-transferring layer faces up toward the undersurface of strip 12 so the carbon or image-transferring layer appears through the two openings 24 and 26 in paper strip 12. Alternately, strip 12 can have separate carbon paper segments suitably secured to it, or a carbon paper strip can be continuous for the length of strip 12, or a suitable carbon paper strip(s) can be physically fastened to strip 12, such as by collating, without use of an adhesive.

In use, paper strip 12 is fed through a computer imprinting mechanism (not shown) which applies imprinting pressure to window areas 20 and 22 of each label 10. Imprinting applied to the upper surface of the label in each window area applies sufficient impact pressure to transfer images 29 (see FIG. 1) to the underside of the translucent film window area from the face-up image-transfer strip below the window. Thus, the strip of labels may be fed through the computer at high speed so the labels can be imprinted with the desired information. Thereafter, each label can be removed from paper strip 12 and applied to a desired substrate using the pressure-sensitive adhesive on the label to fasten the label in place. Thereafter, the film acts as a protective overlay for the underimprinted information in the window areas of the label.

Figure 3:
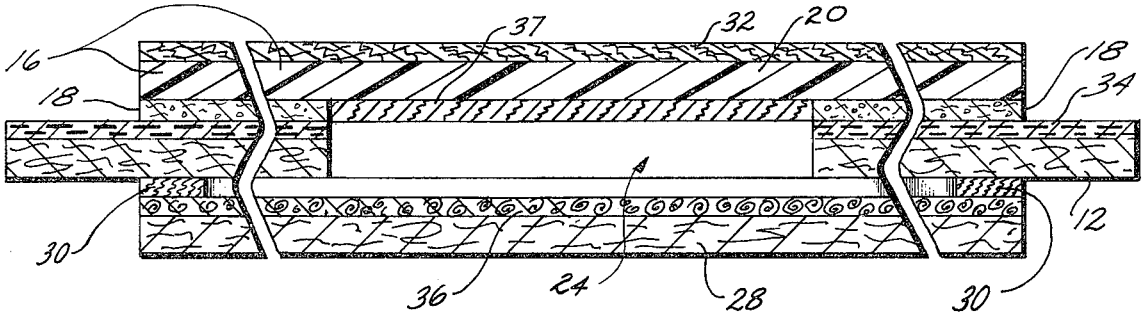
FIG. 3 is a schematic cross-sectional elevation view taken on section 3—3 of FIG. 1.
Figure 7:
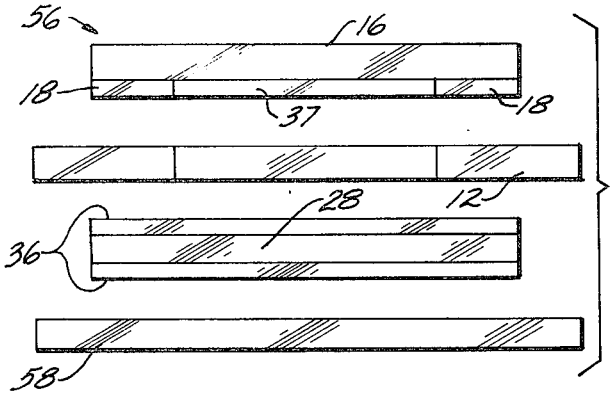
FIG. 7 is a schematic cross-sectional elevation view showing a further alternate embodiment of the label construction shown in FIG. 2.

The detailed construction of the label construction of this invention is understood best by referring to FIG. 3. The self-supporting film 16 may be fabricated from any material of sufficient integrity to provide long term protection of visual indicia transferred to the translucent window areas of the film. Although cellulosic materials may be used, self-supporting film 16 is preferably fabricated from normally solid polymers such as ethylene polymers such as polyethylene, ethylene-vinyl acetate copolymers, ethylene-acrylic acid copolymers and the like; propylene polymers such as polypropylene and ethylene-propylene copolymers and the like; acrylic polymers, vinyl polymers such as polyvinyl acetate, polyvinyl fluoride and the like; cellulose acetate, polycarbonates, polyesters, polyethers, polysulfones, styrene polymers and like polymers which offer good surface life and long term resistance to the elements. In one preferred form, the top surface of film 16 is provided with a matte coating 32, or a suitable surface treatment which also provides an ink-receptive layer on the film so that any overprinting on the film with inks will not be easily smeared during handling of the label, for example.

Paper strip 12 functions as a release liner as well as the carrier for pressure-sensitive labels 10. The upper surface of strip 12 is coated with a suitable release coat 34, such as a silicone release agent, which allows the pressure-sensitive labels to be readily released from paper strip 12 prior to when they are applied to a substrate.

As discussed above, the indicia-transferrable or carbon paper strip 28 is secured to the undersurface of paper strip 12 so that the indicia-transferrable layer, such as a carbon surface layer 36, faces the underside of paper strip 12 and also faces the undersurface of translucent film 16 in the areas where windows 20 and 22 are formed. The use of carbon paper 28 in the present invention is preferred, although any suitable type of indicia-transferring layer can be used below the underside of translucent film 16, as long as the layer is capable of transferring an image to the window areas of the film in response to impact pressure being applied to the top surface of the film window area.

In the label construction shown in FIG. 3, the underside of window areas 20 and 22 includes an image-receptive coat 37 suitable for receiving imprinting, preferably a silica filler in a suitable carrier medium. The image-receptive coat preferably produces a roughened surface below the window areas of the film. The roughened surface allows images to be transferred to the underside of the translucent window area so the imprinting will not be smeared due to any pressure being applied to the top surface of the label once the label is applied to the substrate. The particular image-receptive coat used is dependent upon the particular material film 16 is made of.

In use, the images transferred to the underside of the translucent window areas of the labels are protected by the label itself. The label is then applied to a suitable substrate, and the image-transferring layer, such as the carbon paper, and its release liner are discarded. The color of the substrate will show through the translucent windows of the label and provide a background for the carbon imprinting. When the preferred label film layer is a polyester material, marking is relatively difficult. Surface markings will appear entirely different from those on the underside of the label and thereby be easily distinguished.

The label construction of this invention makes it feasible to economically produce computer-imprinted labels in a one-step imprinting operation. This eliminates the need for labels requiring a protective overlay which are presently used. Furthermore, the intelligence imprinted on the label is durable because of the protection provided by the film layer itself. Thus, the label has an advantage over labels requiring surface printing which is susceptible to being smeared or erased. Moreover, the imprinting is permanent in the sense that indicia cannot be applied to the undersurface of the label window areas when the label is in use without removal of the label.

Figure 4:
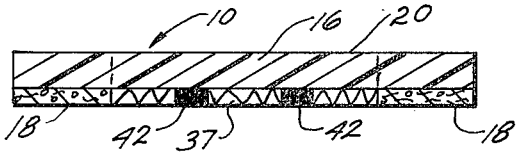
FIG. 4 is a schematic cross-sectional elevation view of an alternate form of the label construction which includes an invisible security feature.

With reference to FIG. 4 to provide protection against tampering invisible ultraviolet brighteners 42 can be added to certain areas of the image-receptive coat 37 on the undersurface of the window areas of film 16. The ultraviolet brighteners illustrated in FIG. 4 are laid down in a pattern, although the brighteners also can be added to cover just the window areas of film 16, or they can cover the whole undersurface of label 10. Thus, in the case of suspected tampering, the label can be viewed with ultraviolet light and the areas where the brighteners are present will show up brightly in such lighting, if the label has not been tampered with.

Figure 5:
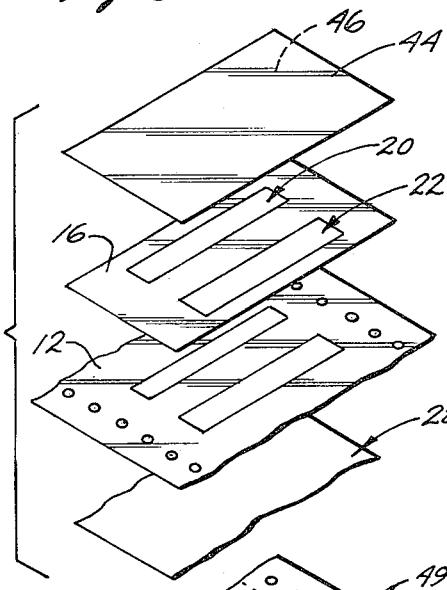
FIG. 5 is an exploded fragmentary perspective view showing an alternate embodiment of the label construction shown in FIG. 2.

FIG. 5 shows an alternate form of the label construction of FIGS. 1 and 2, in which a pressure-sensitive overlay 44 is secured to the top surface of self-supporting film 16. Overlay 44 has a pressure-sensitive adhesive layer 46 on its undersurface which allows overlay 44 to be readily removed from film 16. In use, intelligence printed on the top surface of overlay 44 with sufficient pressure will be simultaneously underimprinted on the underside of the translucent window areas 20 and 22 of film 16. Overlay 44 can serve as a secondary information label or it can be used for record keeping purposes. As an alternative, the overlay can be used as a paint mask or the like.

Figure 6:
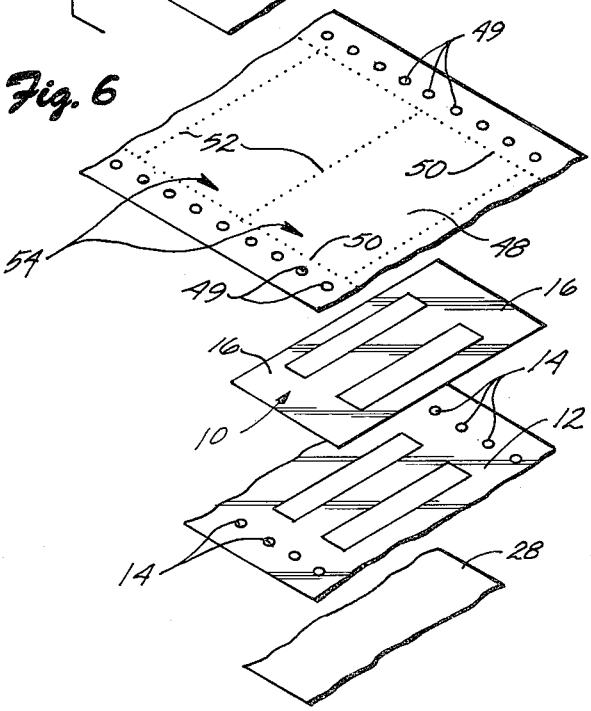
FIG. 6 is an exploded fragmentary perspective view showing an alternate embodiment of the label construction shown in FIG. 5.

FIG. 6 shows an alternate embodiment of the label construction of FIG. 5 in which the pressure-sensitive overlay 44 is replaced with a nonadhesive-backed overlay 48. In FIG. 6, overlay 48 is shown as a continuous strip of paper which is placed over the top surface of a series of pressure-sensitive labels 10 mounted on the release coated strip 12 as described above in FIG. 1. Continuous overlay 48 has marginal pin feed holes 49 along its edges which register with pin feed holes 14 of strip 12 for maintaining overlay 48 in alignment with the remaining portion of the label construction during feed through a computer printer, or the like. Continuous overlay 48 also includes two rows of longitudinally extending perforations 50 along the outer edges of the overlay, together with longitudinally spaced apart, laterally extending rows of perforations 52. The perforations can be used to separate overlay 48 into separate nonadhesive-backed labels to be used for record keeping.

FIG. 8 shows an alternate label construction 56 for providing record keeping information simultaneously with providing underimprinted information on self-supporting label 10. In this instance, the top and bottom surfaces of paper strip 28 have carbon surface layers 36. The doubleface carbon sheet allows information to be printed directly on a copy 58 located under the bottom carbon layer, as well as simultaneously being underimprinted in the window areas of each self-supporting film 16. Copy 58 can either comprise separate pressure-sensitive labels, or it can be a continuous sheet with perforations similar to those shown in FIG. 6 for separating the copy into separate nonadhesive-backed labels to be used in record keeping.

We claim:

1. An undersurface imprintable label construction comprising:

a. a self-supporting film at least a portion of which is translucent, the film having a top surface and a bottom surface;

b. a pressure-sensitive adhesive layer covering only a portion of the bottom surface of the self-supporting film and thereby forming at least one one non-adhesive zone on the film bottom surface coincident with at least a portion of the translucent portion of the film to provide a non-adhesive indicia-receiving window area on the film, c. a release liner below the pressure-sensitive adhesive layer of the self-supporting film to act as a carrier for the self-supporting film, the release liner having a release layer in contact with the pressure-sensitive adhesive layer of the film for allowing the self-supporting film to be readily released from contact with the release liner, and including at least one open window area aligned with the non-adhesive indicia-receiving window area on the film, d. an indicia transferring layer beneath the release liner and facing the open window area of the release liner and aligned window area of the film, the indicia-transferring layer being capable of transferring visual indicia to a surface in contact with it in response to pressure being applied to the indicia-transferring layer, said indicia transferring layer being retained with the release liner upon release of the self-supporting film and pressure-sensitive adhesive layer from the release layer, and e. an indicia-receptive layer on the indicia-receiving window area of the film bottom surface, the indicia-receiving layer allowing indicia to be transferred from the indicia-transferring layer to the bottom surface of the film in the translucent indicia-receiving area thereof in response to the pressure being applied to the indicia-receiving area of the film top surface.

2. The label construction according to claim 1 in which the indicia-transferring layer is a carbon paper sheet, and the indicia-receiving layer is receptive to carbon being released from the carbon paper sheet in response to impact pressure being applied to the indicia-receiving area of the film.

3. The label construction according to claim 1 including a series of separate sheets of said film carried on the release liner.

4. The label construction according to claim 3 in which the release liner is an elongated continuous web, and in which the release liner includes means thereon for feeding it in continuous fashion along a longitudinal path through a printing machine or the like.

5. The label construction according to claim 1 including a smudge-proof layer applied to the top surface of the film.

6. The label construction according to claim 1 in which the indicia-receiving layer includes a coating which provides a roughened surface.

7. The label construction according to claim 1 in which the indicia-receiving area of the film has a top surface and a bottom surface, the bottom surface facing the indicia-transferring layer, and including an overlabel having an undersurface covering at least a portion of the top surface of the indicia-receiving area of the film, the overlabel also having a top surface adapted to accept printed indicia simultaneously with imprinted indicia being transferred to the indicia-receiving area of the film.

8. The label construction according to claim 7 including a pressure-sensitive adhesive layer on the undersurface of the overlabel for adhesive contact with the top surface of the self-supporting film.

9. The label construction according to claim 7 including means for holding the overlabel in non-adhesive contact with the top surface of the self-supporting film.

10. The label construction according to claim 9 in which the overlabel is a continuous sheet, and including perforations in the continuous sheet for separating the sheet into separate labels.

11. The label construction according to claim 1 including a second indicia-receptive layer below the indicia-transferring layer, and in which the indicia-transferring layer has one surface facing the indicia-receiving area of the film and a second surface facing the second indicia-receiving layer so that indicia can be transferred from both surfaces of the indicia-transferring layer to both indicia-receiving layers in response to pressure being applied to the film top surface.

* * * * *

UNITED STATES PATENT AND TRADEMARK OFFICE

CERTIFICATE OF CORRECTION

PATENT NO. : 3,973,788

DATED : August 10, 1976

INVENTOR(S) : John A. Pekko/Robert J. Cardenas

It is certified that error appears in the above-identified patent and that said Letters Patent are hereby corrected as shown below:

Column 3, line 1, "to a translucent or transparent film 16", should be deleted.

Signed and Sealed this

Eighteenth Day of January 1977

[SEAL]

*Attest:*

RUTH C. MASON
*Attesting Officer*

C. MARSHALL DANN
*Commissioner of Patents and Trademarks*